US005253621A

United States Patent [19]

Dopson et al.

[11] Patent Number: 5,253,621

[45] Date of Patent: Oct. 19, 1993

[54] VALVE CONTROL MEANS

[75] Inventors: Clive Dopson; Jeffrey Allen, both of Norwich, United Kingdom

[73] Assignee: Group Lotus PLC, Norfolk, United Kingdom

[21] Appl. No.: 44,816

[22] Filed: Apr. 8, 1993

Related U.S. Application Data

[63] Continuation-in-part of Ser. No. 920,389, Aug. 14, 1992.

[51] Int. Cl.[5] ..... F01L 1/34

[52] U.S. Cl. ..... 123/90.16; 123/90.17; 123/90.48

[58] Field of Search ..... 123/90.15, 90.16, 90.17, 123/90.22, 90.39, 90.48, 90.52, 90.55

[56] References Cited

U.S. PATENT DOCUMENTS

| | | | |
|---|---|---|---|
| 4,151,817 | 5/1979 | Mueller | 123/90.16 |
| 4,222,354 | 9/1980 | Uitvlugt | 123/90.16 |
| 4,230,076 | 10/1980 | Mueller | 123/90.16 |
| 4,411,229 | 10/1983 | Curtis et al. | 123/198F |
| 4,452,187 | 6/1984 | Kosuda et al. | 123/90.16 |
| 4,475,489 | 10/1984 | Shoichi Honda | 123/90.16 |
| 4,537,165 | 8/1985 | Honda et al. | 123/90.16 |
| 4,559,909 | 12/1985 | Honda et al. | 123/90.28 |

(List continued on next page.)

FOREIGN PATENT DOCUMENTS

| | | |
|---|---|---|
| 1,476,357 | 6/1977 | United Kingdom . |
| DE 27 53 197 | 6/1978 | Fed. Rep. of Germany . |

(List continued on next page.)

OTHER PUBLICATIONS

SAE TECHNICAL PAPER SERIES—#890675 2/1989.

(List continued on next page.)

*Primary Examiner*—E. Rollins Cross
*Assistant Examiner*—Weilun Lo
*Attorney, Agent, or Firm*—Fulwider Patton Lee & Utecht

[57] ABSTRACT

The invention relates to valve control means for a push-rod internal combustion engine. With reference to FIG. 8 of the drawings, the valve control means comprises valve means, cam means comprising a camshaft having a first cam member and a second cam member having a different profile from the first cam member, and means for transmitting reciprocating movement to the valve means from the cam means. The means for transmitting reciprocating movement comprises a first cam follower member in engagement with the push-rod and a second cam follower member movable relative to the first cam follower member, and locking means to enable the follower members to be linked to move together. When the cam follower members are not linked the valve means is controlled by the first cam follower member in engagement with and following the profile of the first cam member, and when the cam follower members are linked the valve means is controlled by the second cam follower member in engagement with and following the profile of the second cam member.

22 Claims, 7 Drawing Sheets

U.S. PATENT DOCUMENTS

| | | | |
|---|---|---|---|
| 4,576,128 | 3/1986 | Kenichi | 123/198F |
| 4,690,110 | 9/1987 | Nishimura et al. | 123/90.17 |
| 4,718,379 | 1/1988 | Clark | 123/90.39 |
| 4,727,831 | 3/1988 | Nagahiro et al. | 123/90.16 |
| 4,741,297 | 5/1988 | Nagahiro et al. | 123/90.16 |
| 4,762,096 | 8/1988 | Kamm et al. | 123/90.16 |
| 4,779,589 | 10/1988 | Matsuura et al. | 123/315 |
| 4,892,067 | 1/1990 | Paul et al. | 123/90.16 |
| 5,002,022 | 3/1991 | Perr | 123/90.16 |
| 5,090,364 | 2/1992 | McCarroll et al. | 123/90.16 |
| 5,158,048 | 10/1992 | Robnett et al. | 123/90.16 |
| 5,161,500 | 11/1992 | Kubis et al. | 123/90.16 |
| 5,193,496 | 3/1993 | Kruger | 123/90.16 |

FOREIGN PATENT DOCUMENTS

| | | |
|---|---|---|
| 1,551,360 | 8/1979 | United Kingdom . |
| 1,569,598 | 6/1980 | United Kingdom . |
| 1,604,707 | 12/1981 | United Kingdom . |
| DE3347680 | 8/1984 | Fed. Rep. of Germany . |
| 0213758 | 3/1987 | EPO |
| 0262269 | 4/1988 | EPO |
| 0265191 | 4/1988 | EPO |
| 0213759 | 3/1987 | EPO |
| 0259106 | 3/1988 | EPO |
| 0264253 | 4/1988 | EPO |
| 0258061 | 3/1988 | EPO |
| 0265281 | 4/1988 | EPO |
| 0265282 | 4/1988 | EPO |
| 0267696 | 5/1988 | EPO |
| 0275713 | 7/1988 | EPO |
| 0275714 | 7/1988 | EPO |
| 0275715 | 7/1988 | EPO |
| 0276531 | 8/1988 | EPO |
| 0276532 | 8/1988 | EPO |
| 0276533 | 8/1988 | EPO |
| 0276577 | 8/1988 | EPO |
| 0291357 | 11/1988 | EPO |
| 0293209 | 11/1988 | EPO |
| 0297791 | 1/1989 | EPO |
| 0300679 | 1/1989 | EPO |
| 0312216 | 4/1989 | EPO |
| 0317371 | 5/1989 | EPO |
| 0317372 | 5/1989 | EPO |
| 0318303 | 5/1989 | EPO |
| 0323233 | 7/1989 | EPO |
| 0338729 | 10/1989 | EPO |
| 0342007 | 11/1989 | EPO |
| 0342051 | 11/1989 | EPO |
| 0343931 | 11/1989 | EPO |
| 0347211 | 12/1989 | EPO |
| 0353862 | 2/1990 | EPO |
| 0353863 | 2/1990 | EPO |
| 0353988 | 2/1990 | EPO |
| 0359363 | 3/1990 | EPO |
| 0364081 | 4/1990 | EPO |
| 2196694 B | 9/1990 | United Kingdom . |
| 0405927 A1 | 1/1991 | EPO |

OTHER PUBLICATIONS

J. Yamaguchi "Variable Valve Timing and Lift from Honda", Automotive Engineering Jan. 1989 pp 84–85.

Patent Abstract Vol. 9 No. 22 Jan. 30, 1985 re published Japanese application 59-168208A.

VALVE CONTROL MEANS

This application is a continuation-in-part application Ser. No. 07/920,389 filed Aug. 14 1992.

The invention relates to a valve control means for controlling the inlet and exhaust valves of an internal combustion engine.

Internal combustion engines for use in, for example, vehicles, must be capable of operation at various engine speeds and loads. The timing of the opening and closing of the intake and exhaust valves must be set to optimise the power output and efficiency of the engine over a reasonable range of speeds and loads.

For example, in a high output, multi-valve, spark ignition four stroke engine which is designed to operate at high engine speeds, it is generally desirable to provide means, such as cams, to control the opening of the inlet valves which preferably have a long valve opening period, in order to maximise the combustible charge drawn into the combustion chambers during the suction strokes of the engine. This has the advantage of improving the volumetric efficiency of the engine, thereby increasing the maximum power and torque outputs of the engine.

However, if such an engine is operated at speeds below that at which maximum power is developed, since the inlet valves are open for a relatively long period, some of the combustible charge drawn into each combustion chamber on its suction stroke can be forced back through the valve before it closes. This effect clearly reduces the volumetric efficiency, and hence the output, of the engine. It also causes uneven engine idling and low speed operation, and also makes exhaust emissions more difficult to control.

It is therefore desirable to additionally provide a valve control mechanism for use only at low engine speeds which has a relatively short operating or opening period.

There have already been a number of proposals for variable valve timing devices in which means are provided for changing the duration of the opening of the valve in an internal combustion engine.

For example in U.S. Pat. No. 4,727,831 a pair of adjacent valves are controlled to operate together by means of rocker shafts and cams. The two valves are normally driven from the camshaft by two low-speed cams (i.e. cams causing the valves to open for a short duration) operating on separate rocker arms for each valve but a third rocker arm is mounted between the two aforesaid rocker arms and is arranged to be driven by a high-speed cam (i.e. a cam causing the valve to open for a long duration). When it is desired to operate the valves via the high-speed cam the third rocker arm is connected to the other two rocker arms so that the valves are both driven via the third rocker arm.

In U.S. Pat. No. 4,475,489 a valve is driven either by a first rocker arm driven by a high-speed cam or a second rocker arm driven by a low-speed cam and means is provided to move the two rocker arms between operative and inoperative positions whereby the valve is driven by either of the rocker arms. There is an overlap between the high-speed and low-speed positions where both rocker arms are driving the valve in order to overcome the problem that if there is no overlap both of the rocker arms will be at intermediate positions at which an undesirable impact takes place between the valve and the rocker arms.

In PCT application publication No. W091/12415 a valve is controlled by a pair of rocker arms which are movable into direct or indirect engagement by high speed or low speed cam means. A locking hydraulic piston arrangement is operable to move a cam follower mounted on one of said rocker arms into engagement with a high speed cam to provide high speed control of the valve. When this arm is retracted the cam follower mounted on the other arm is in sole engagement with a different profile of the cam to provide low-speed control.

GB-A-2017207 illustrates a variable type valve timing mechanism having a tapered finger which in different positions causes different profiles of cam means to engage and control directly or indirectly the tappet mounted on the valve.

According to the present invention there is provided valve control means for a push-rod internal combustion engine comprising valve means, cam means comprising a rotatable camshaft having a first cam member and a second cam member having a different profile from said first cam member, and means for transmitting reciprocating movement to the valve means from said cam means, said means comprising a rocker arm means in engagement with said valve means, a push rod connected to the rocker arm means, a first cam follower member in engagement with the push rod and a second cam follower member movable relative to said first cam follower member, and locking means to enable said cam follower members to be linked so as to move together, wherein when the cam follower members are not so linked the valve means is controlled by the first cam follower member in engagement with and following the profile of the first cam member and when the cam follower members are linked the valve means is controlled by the second cam follower member in engagement with and following the profile of the second cam member.

Thus it is possible to switch between one cam and another to accomodate different speeds and loads of the engine.

Preferably the second cam follower member has a bore therethrough and the first cam follower member is in the form of an inner member located within the bore, said first cam follower member being moveable in the bore relative to the second cam follower member when the cam follower members are not linked to move together.

Preferably the second cam follower member is generally cylindrical and has a generally cylindrical bore therethrough and the first cam follower member is a cylindrical member located within the cylindrical bore of the second cam follower member.

Preferably the locking means comprises a locking element moveable within the second cam follower member between a first position in which the cam follower members are not linked and a second position in which the locking element engages a recess provided on the exterior of the first cam follower member to lock the two cam follower members.

Preferably only the first cam follower directly abuts the push-rod whereby whilst the cam follower members are disconnected the second cam follower member remains disconnected from the push-rod and transmits no motion thereto.

Preferably the first cam follower comprises hydraulic lash adjustment means.

Preferably the first and second cam follower member each respectively directly abut the first and second cam members.

Preferably the valve means comprises a poppet valve moveable in a bore in a cylinder head of the push-rod internal combustion engine and spring means acting between the poppet valve and the cylinder head to bias the valve into engagement with a valve seat provided therefor, the spring means also acting, via the rocker arm means and the push rod, to bias the first cam follower member into engagement with the first cam member.

Preferably the valve control means comprises a third cam member on the rotatable camshaft having the same profile as the second cam member and provided in the side of the first cam member opposite to the second cam member wherein the second cam follower member engages with and follows the profiles of both the second and third cam members.

Preferably actuating means are provided to actuate and de-actuate the locking means for different speeds and loads of the engine, which actuating means are manually or automatically operable.

Preferably the follower means are linked at higher engine speeds to improve efficiency of the engine.

Preferably the locking means comprises a locking element movable within said second cam follower member and held restrained in an unlocked position by spring means. The locking means preferably comprises a locking element movable within said second cam follower member and held restrained in an unlocked position by fluid pressure and the locking element preferably has a shaped surface adapted to co-operate with a complementary surface of said first cam follower member in a locked position.

Preferably the locking element is moved from an unlocked position to a locked position by means of fluid pressure.

Preferably the first cam follower member is biased toward the second cam member by spring means, the spring means preferably holding the second cam follower member in engagement with the second cam member when the cam follower members are not linked to move together.

The present invention also provides a push-rod internal combustion engine having valve control means as previously described wherein the cylinder block of the engine has a bore in which the first and second cam follower members are located, the second cam follower member being slidable in the bore relative to the cylinder block.

In a preferred method of operation of the valve control means when the second cam follower member is linked in engagement with said first cam follower member there is a gap between said first cam follower member and said first cam member during the period when the second cam member engages the camming portion of the second cam member.

The present invention further provides valve control means for a push-rod internal combustion engine comprising valve means, cam means comprising a rotatable camshaft having a cam member and a lobe of circular axial cross-section, means for transmitting reciprocating movement to the valve means from said cam means, said means comprising rocker arm means in engagement with said valve means, a push-rod connected to the rocker arm means, a first cam follower member engaging the push-rod and a second cam follower member movable relative to said first cam follower member, and locking means to enable said follower members to be linked so as to move together, wherein when the follower members are not so linked the valve means is controlled by the first cam follower member in engagement with and following the profile of the lobe of circular cross-section and when the follower members are linked the valve means is controlled by the second cam follower member in engagement with and following the profile of the cam member.

The invention further provides an internal combustion engine having valve control means as hereinbefore described.

There will now be described specific embodiments of the invention, by way of example only, with reference to and as shown in the accompanying drawings in which.

Figure 1:
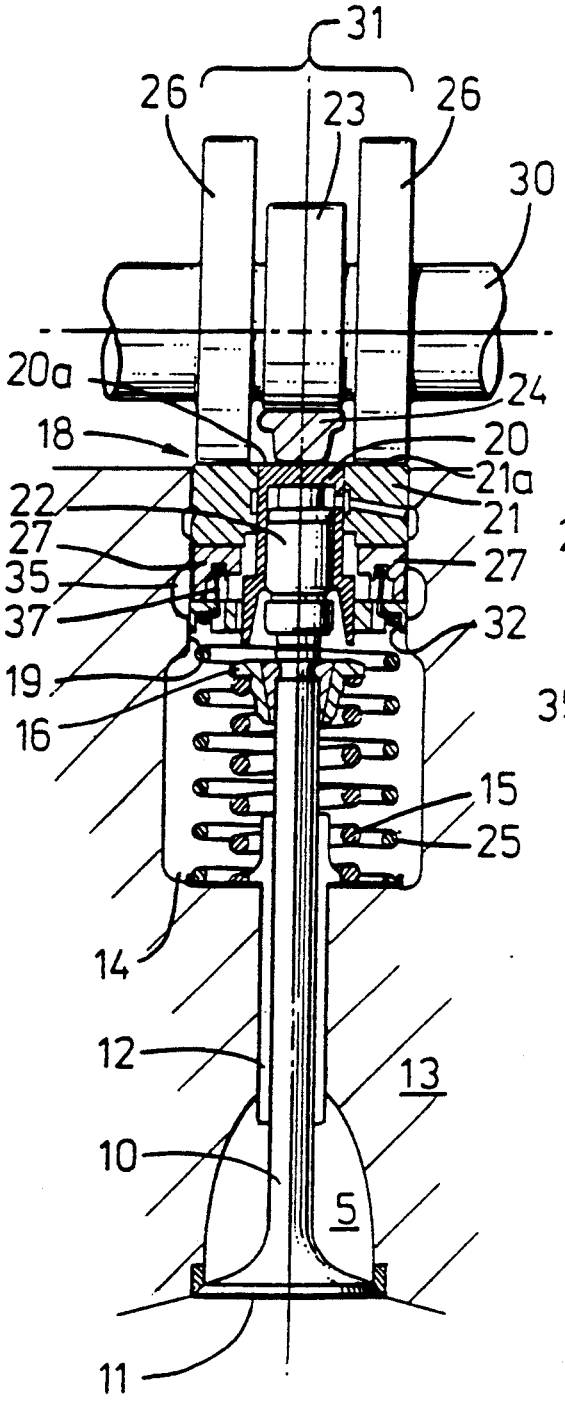
FIG. 1 is a side sectional view of a tappet and valve assembly for an overhead camshaft internal combustion engine.
Figure 2:
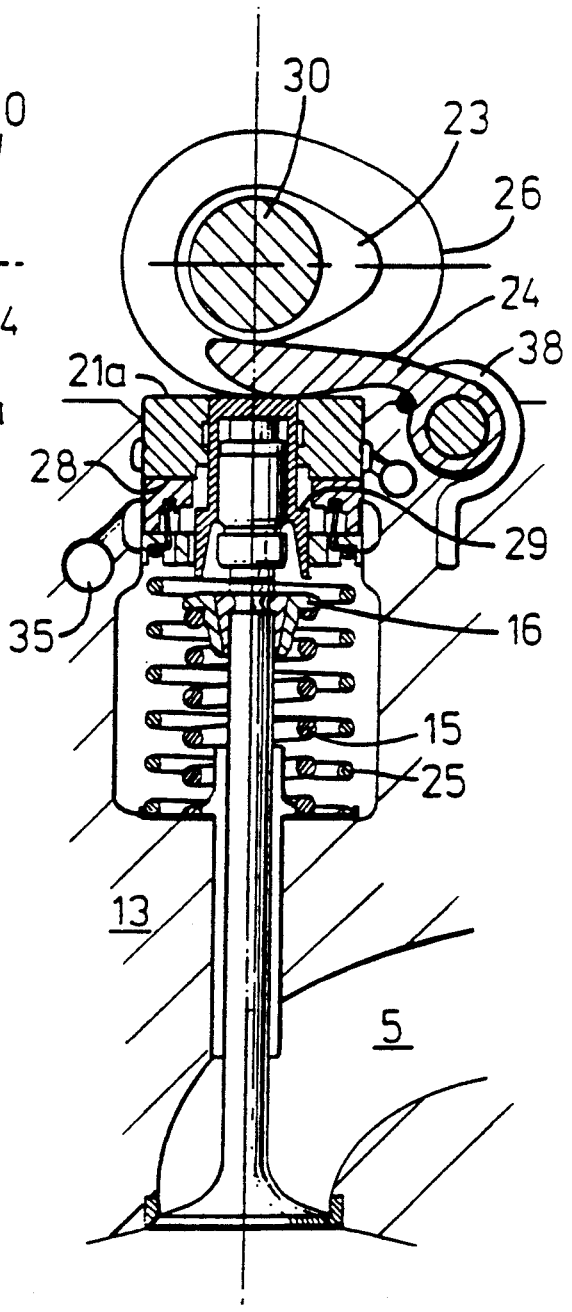
FIG. 2 is a vertical sectional view of the valve and tappet assembly of FIG. 1.

An internal combustion engine (not shown) has a plurality of pistons slidably mounted within a plurality of cylinders in a cylinder block 13 a portion of which is shown in FIG. 1. Each cylinder has an intake and an exhaust passage 5 and an intake and exhaust valve 10 movable to open or close the passages.

It is apparent that the invention may be applied both to inlet and exhaust valves and although only a single valve is referred to and described in the following description it should be recognised that it may also refer to inlet and/or exhaust valves, a plurality of one type of valve or both.

Referring to FIG. 1 there is shown a valve 10 having a head 11 which is movable in an axial direction to seal the passageway 5. The valve 10 is slidably mounted in a bore 12 in cylinder block 13 and passes through a cavity 14. In the cavity 14 around valve 10 there is located a spring 15 one end of which rests against a lower surface of said cavity 14 and the other end of which is located in a collar 16 mounted on the valve 10 so as to generally bias the valve 10 in an upwards direction.

Mounted on an upper end of valve 10 is a tappet assembly 18. The tappet assembly 18 comprises a co-axial inner tappet 20 and outer tappet 21. The inner tappet bears on a hydraulic lash adjustment element 22 of known type which in turn bears on the upper end of valve 10. The tappet assembly 18 is slidably mounted within bore 19 which extends from the cavity 14 to the upper surface of the cylinder block 13. A cylinder head cover may be positioned over and secured to the upper surface of the cylinder block 13.

Located above the cylinder block 13 is a rotatable camshaft 30, which is drivable in the usual manner. Located on the camshaft 30 is a cam arrangement 31, which comprises a pair of outer cam lobes 26 in between which is situated a central cam lobe 23. The central cam lobe 23 has a profile designed to optimise engine performance over a selected portion of engine speed and load range. Although the central cam lobe 23 is illustrated as having a generally eccentric form it is envisaged that this cam lobe can be a circular form allowing valve deactivation while under control of this cam lobe. The outer cam lobes 26 are of a substantial identical profile to each other and are designed to optimise engine performance over another portion of engine speed and load range.

The camshaft 30 is located such that in low speed conditions an upper surface 20*a* of the inner tappet 20 is driven by the central cam lobe via finger follower 24. The upper surface 21*a* of outer tappet 21 is kept in contact with the outer cam lobes 26 by means of a spring 25 which is co-axially positioned around spring 15 and which locates at one end in recesses 32 in the lower end surface of outer tappet 21. At its lower end spring 25 bears on the lower surface of cavity 14.

Cam profile selection is achieved by either connecting the inner tappet 20 and outer tappet 21 so that they move together which allows the outer tappet 21 and outer cam lobes 26 to control the valve 10 or by disconnecting the inner tappet 20 and outer tappet 21, which allows the inner tappet 20 and inner cam lobe 23 to control valve 10.

One method of achieving this connection is by the use of locking pins 27, shown in FIGS. 1-5. The locking pins 27 slide in transverse bores 28 in the outer tappet 21 and are engagable with a stepped diameter 29 on the inner tappet 20 while the cam 31 is on its base circle, i.e. whilst the valve 10 is closed.

Figure 3:
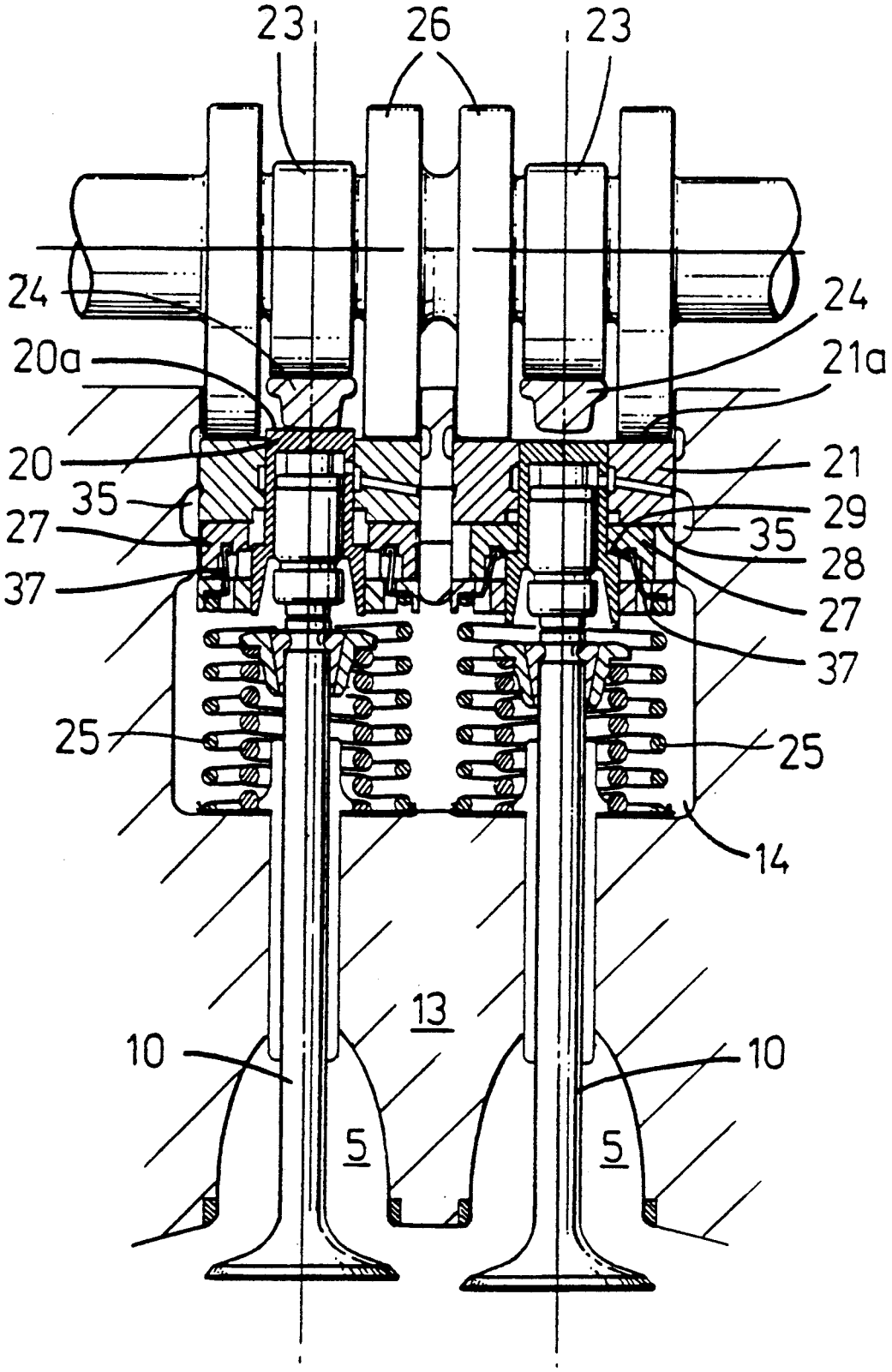
FIG. 3 is a side sectional elevation of two of the adjacent tappet and valve assemblies of FIG. 1 in different conditions.

During the deactivated state the locking pins 27 are in their retracted position as shown in the left hand portion of FIG. 3. The pins 27 can be held in this position by either a return spring 37 or oil pressure on the inboard surfaces. With the pins in this position there is no connection between the inner tappet 20 and outer tappet 21. Since outer tappet 21 moves against spring 25, the valve 10 is driven solely by the inner tappet 20 by central cam lobe 23 bearing on finger 24.

In the activated state, the locking pins 27 are forced inwards by hydraulic oil pressure on their outer surfaces provided by gallery feed 35. The oil pressure must be sufficient to overcome the spring force or oil pressure on the inner surface of the locking pins 27. In this position, the locking pins 27 engage with the stepped diameter 29 on the inner tappet 20 thus forming a driving connection between the inner tappet 20 and outer tappet 21.

Because of the difference in radii of the outer and inner cam lobes, only the outer cam lobes 26 bear on the surface 21*a* of the outer tappet 21 whilst there is a gap between the inner tappet 20 and the central cam lobe 23. Since both tappets 20, 21 are constrained to move together the large profile of the outer cam lobe 26 governs the movement of valve 10. In this condition the finger follower 24 is held in contact with the central cam profile 23 by a spring 38.

Figure 4:
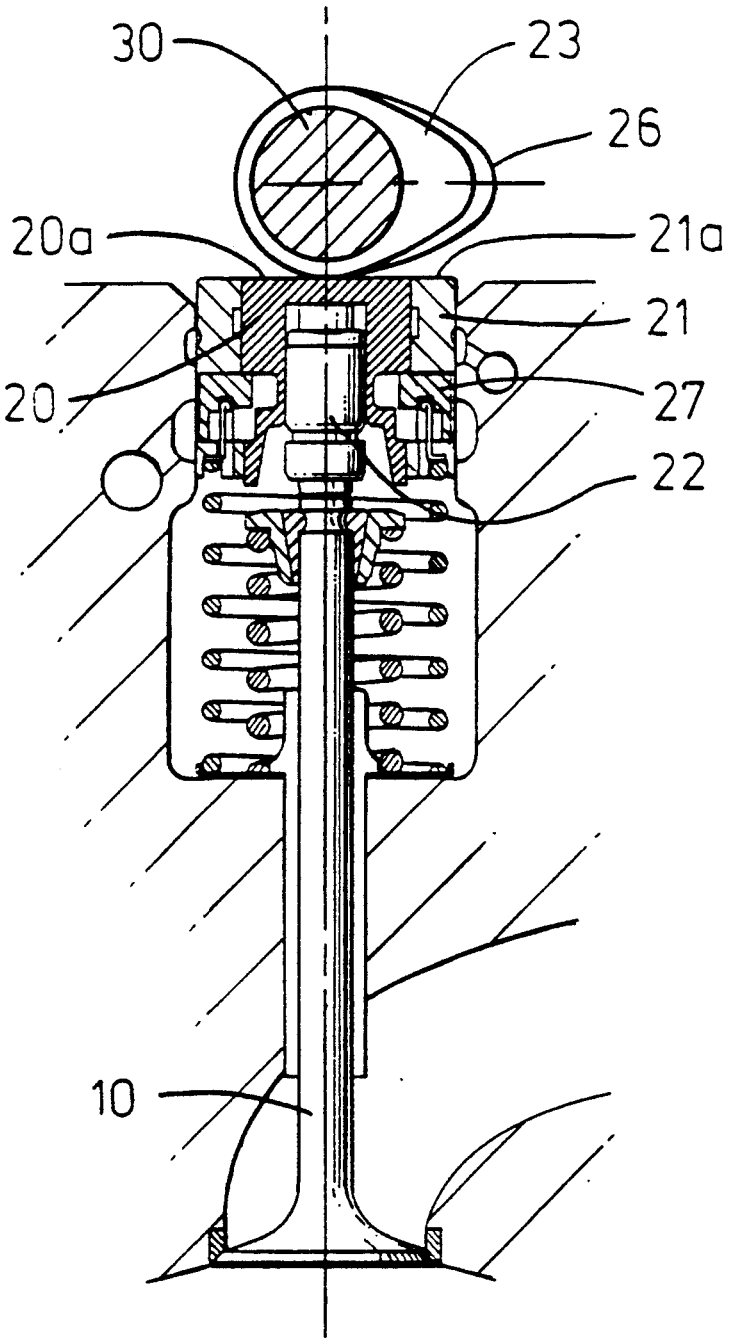
FIG. 4 is an alternative valve and tappet arrangement to that shown in FIG. I again for an overhead camshaft engine.
Figure 5:
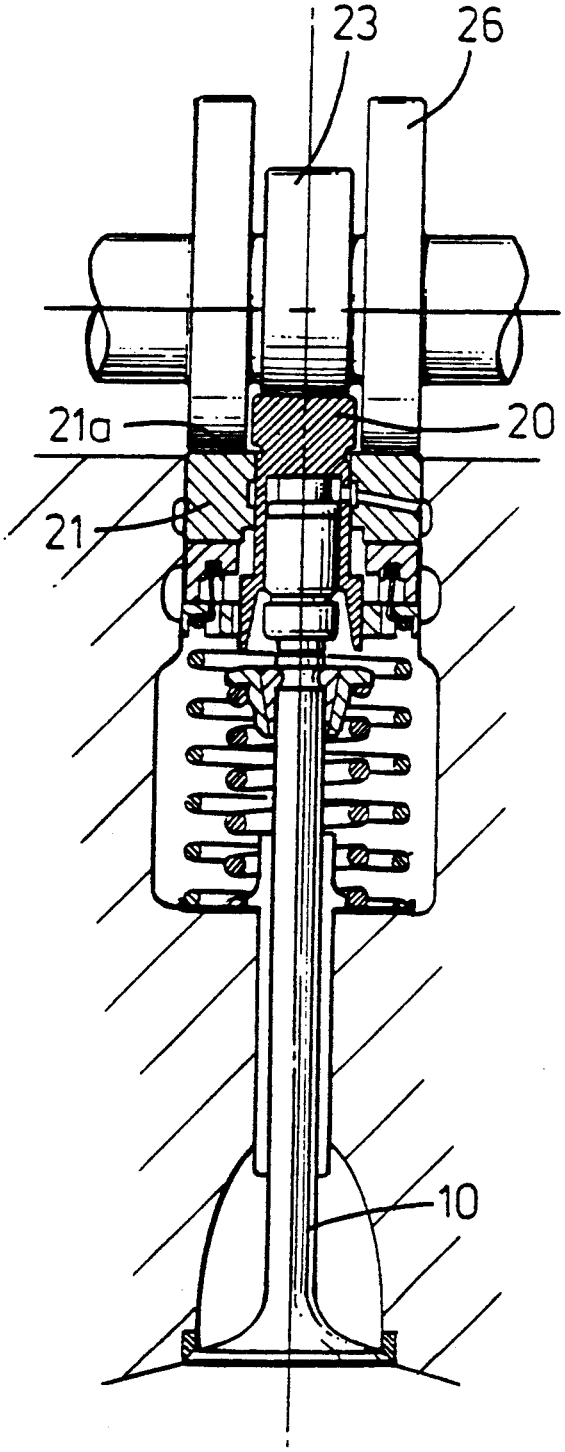
FIGS. 5 and 6 are views of another alternative embodiment for an overhead camshaft engine.
Figure 6:
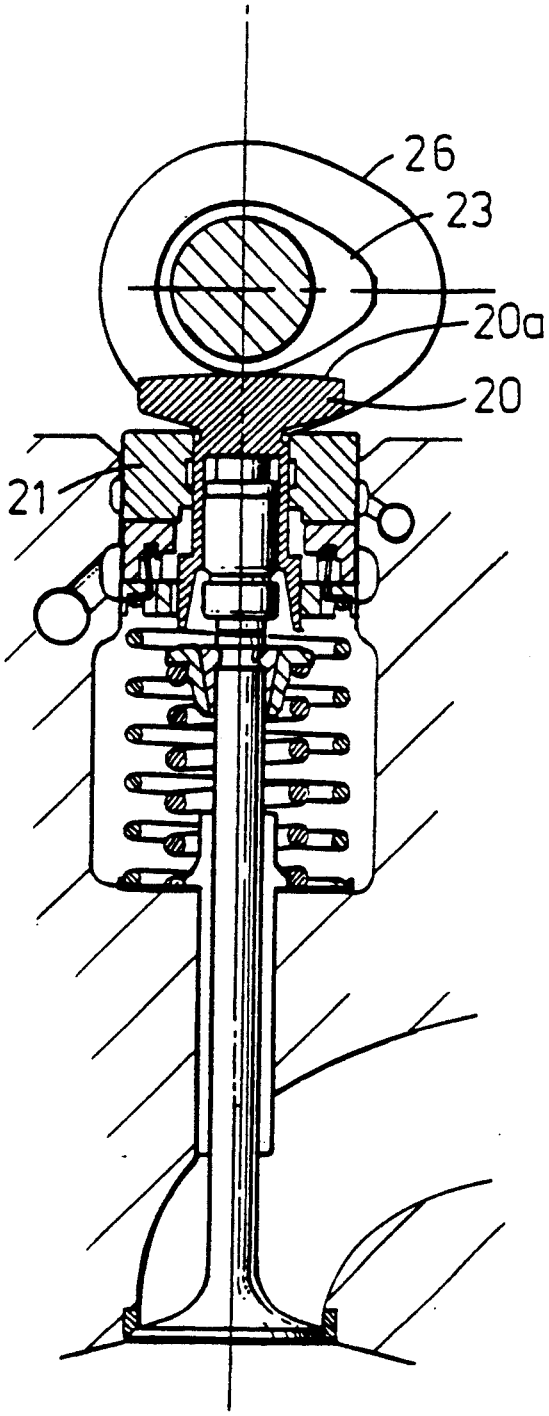

FIG. 4 illustrates an alternative arrangement in which the inner tappet 20 is driven directly by the central cam lobe 23 rather than via finger follower 24. FIGS. 5 and 6 illustrate yet another alternative embodiment where the inner tappet 20 is driven directly by the central cam lobe 23 in which the inner tappet 20 has a different shape than that shown in FIG. 4.

Figure 7:
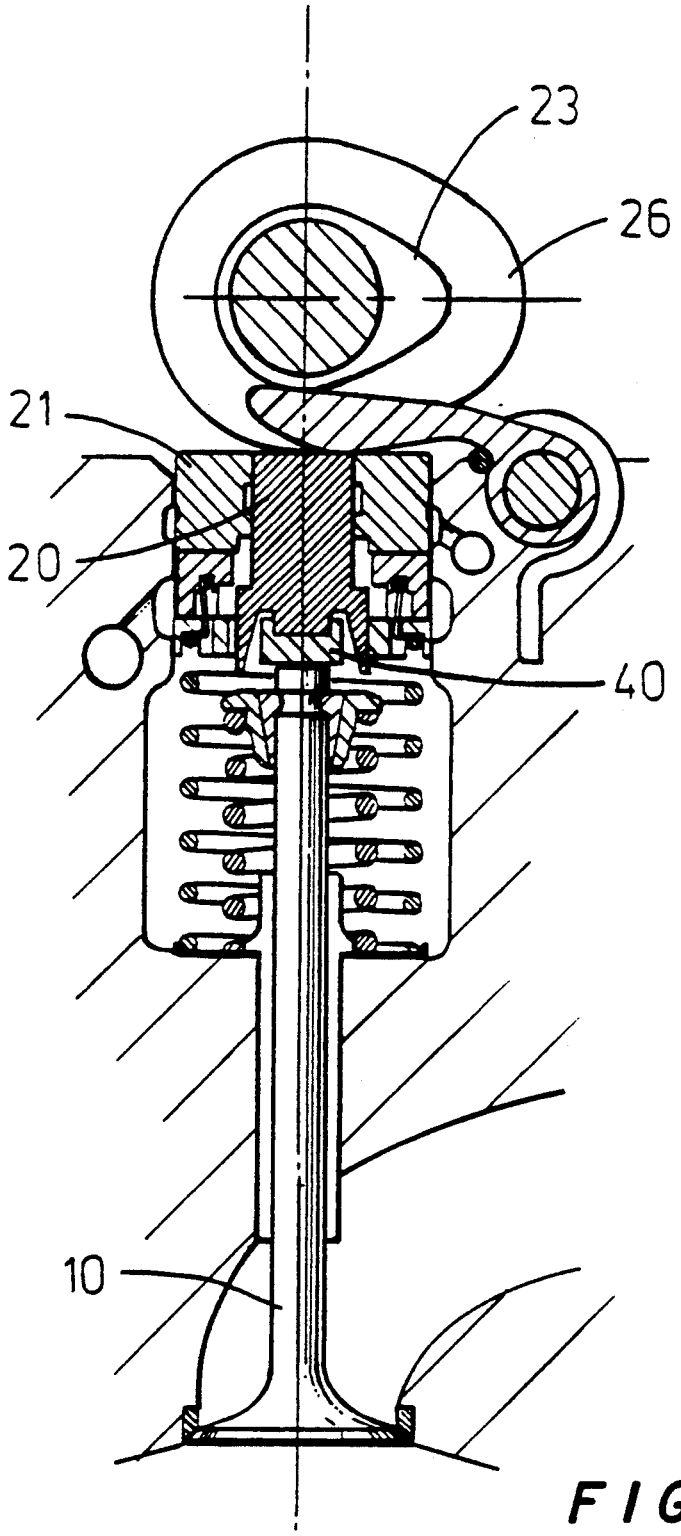
FIG. 7 is another alternative tappet and valve assembly to the arrangement of FIG. 1 again for an overhead camshaft engine.

FIG. 7 illustrates a further embodiment of the invention whereby the hydraulic element 22 is replaced by a conventional shim 40 such that the central tappet 20 acts directly on the valve 10.

Figure 8:
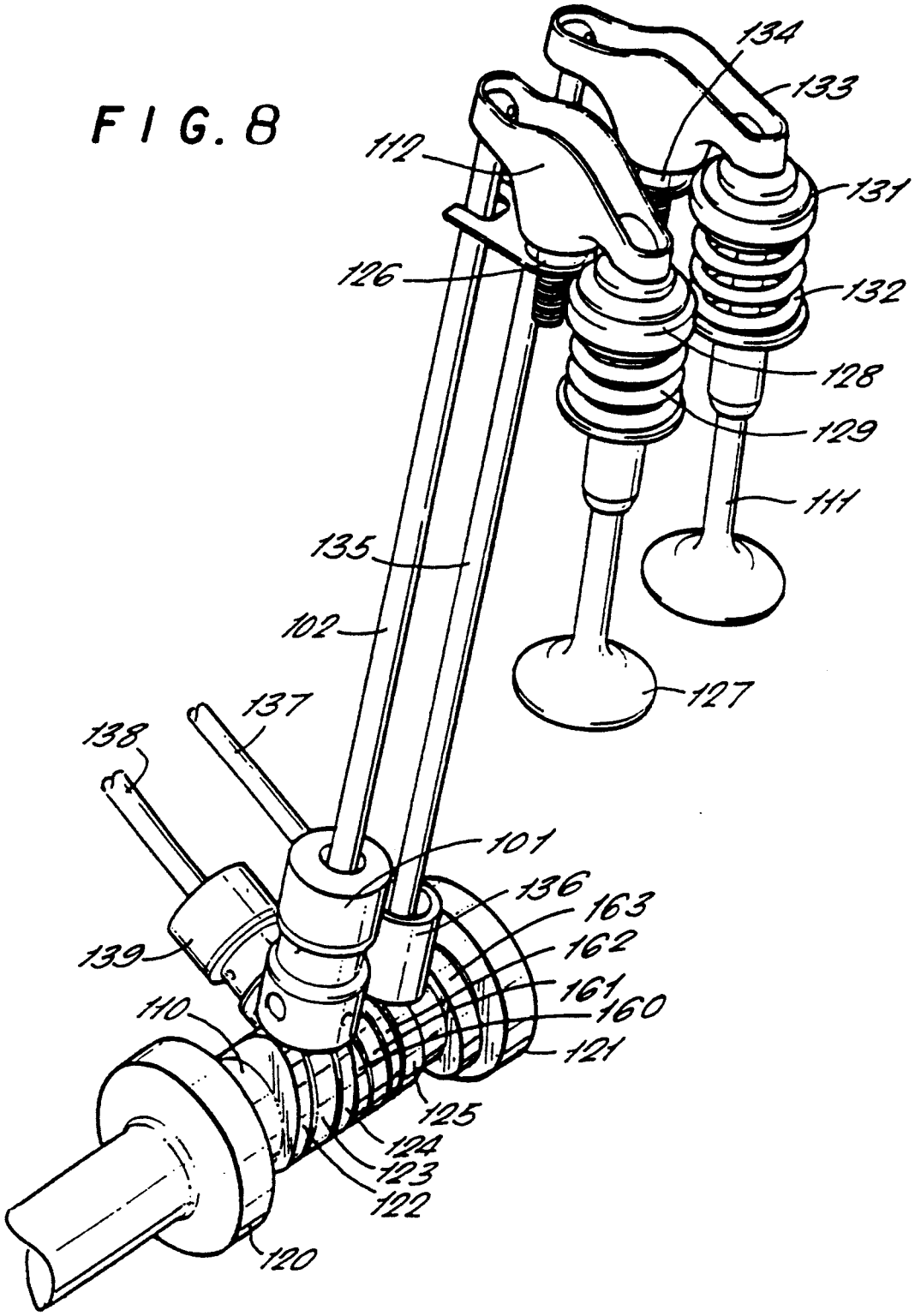
FIG. 8 is a diagrammatic view of a valve, a push rod and a tappet assembly for a push rod internal combustion engine.

FIG. 8 shows schematically an embodiment of the invention for a vee configuration push-rod internal combustion engine. The figure shows a camshaft 110 mounted for rotation in bearings 120 and 121. Cams 122, 123, 124 and 125 are provided for controlling the motion of the valves in a cylinder of one bank of cylinders. They are provided on the camshaft 110 (a portion of which is shown in the figure) and the cams rotate with the camshaft 110. In the embodiment shown the cams 122 and 124 have the same profile and cam 123 has a different lower lift profile.

A tappet assembly 101, similar to the tappet assemblies described above, is provided to selectively engage either the cam 123 or both of cams 122 and 124 (this will be described in greater detail later). The tappet assembly also engages a push-rod 102 at the lower end of the push-rod 102.

The push-rod engages at its upper end a rocker arm 112. The push-rod 102 is secured to the rocker arm 112 by a connection which allows rocking of the rocker arm 112 relative to the push-rod 102.

The rocker arm 112 is mounted at a cylinder head of a push-rod engine (not shown) by a fulcrum 126 which allows rocking of the arm. The fulcrum 126 is secured to the cylinder head by suitable means; in the drawing the fulcrum 126 is provided with a threaded portion which will engage a matching threaded recess in the cylinder head.

The end of the rocker arm 112 distant from the push rod 102 engages the top of an inlet valve 127. The inlet valve 127 will open and close the inlet port of a cylinder of the internal combustion engine. The valve 127 is provided at the top end thereof with a spring retainer 128. A spring 129 acts between the spring retainer 128 and the cylinder head (not shown). The spring 129 will bias the valve 127 into a valve seat.

Also shown in the FIG. 8 is an exhaust valve 111 which opens and closes an exhaust port located in the same cylinder of the engine as the inlet port closed by inlet valve 127. As with the inlet valve 127, the exhaust valve 111 has a spring retainer 131 at the top thereof with a spring 132 acting between the valve retainer 131 and the cylinder head to bias the exhaust valve 111 into engagement with a valve seat.

The top of the exhaust valve 111 is engaged by a rocker arm 133 which is identical to rocker arm 112. The rocker arm 133 is rockable about a fulcrum 134 which is identical to the fulcrum 126. A push-rod 135 engages the end of the rocker arm 133 distant from the exhaust valve 111.

The push rod 135 at the lower end thereof is provided with a hydraulic lash adjuster 136. The hydraulic lash adjuster 136 engages the cam 125 provided on the cam shaft 110. The hydraulic lash adjuster 136 is a conventional lash adjuster, well known in the prior art.

The schematic drawing of FIG. 8 shows an arrangement for a vee engine and therefore it will be appreciated that the push-rods 102 and 101 extend along one bank of the vee engine to actuate the valves in one cylinder of one bank of the engine. There is partially shown in the drawing two further push-rods 137 and 138 which will extend up the second bank of cylinders of the vee engine to a cylinder head valve arrangement which is the mirror image of the valve arrangement shown in the figure.

The push rod 138 will be connected via a rocker arm to an inlet valve of a cylinder the second bank of cylinders and the push-rod 138 is provided at its lower end with a tappet assembly 139 identical to the tappet assembly 101. The tappet assembly 139 will selectively engage either the cam 161 or will simultaneously engage both the cams 160 and 162. The three cams 160, 161 and 162 are provided on the camshaft 110 between the cams 124 and 125. The cams 160, 161, 162 rotate with rotation of the camshaft 110. In the preferred embodiment cams 160 and 162 are identical in profile to each other and cam 161 is of a different profile.

In the preferred embodiment cams 160 and 162 each have the same profile as cams 122 and 124. Similarly cam 161 has the same profile as cam 123. The cams 160, 161 and 162 are mounted on the camshaft 110 such that they are not in angular alignment with cams 122, 123, 124.

The push-rod 137 will be provided at its lower end with a hydraulic lash adjuster identical to the lash adjuster 136. The push rod 137 will be connected via a rocker arm to an exhaust valve of the cylinder of the second bank of cylinders in which the inlet valve actuated by push rod 138 is present. A cam 163 is provided on the camshaft 110 spaced along the camshaft 110 from cam 125. The cam 163 controls the motion of the exhaust valve in the second bank of the cylinder of the rotary vee engine via the push-rod 137.

Figure 9:
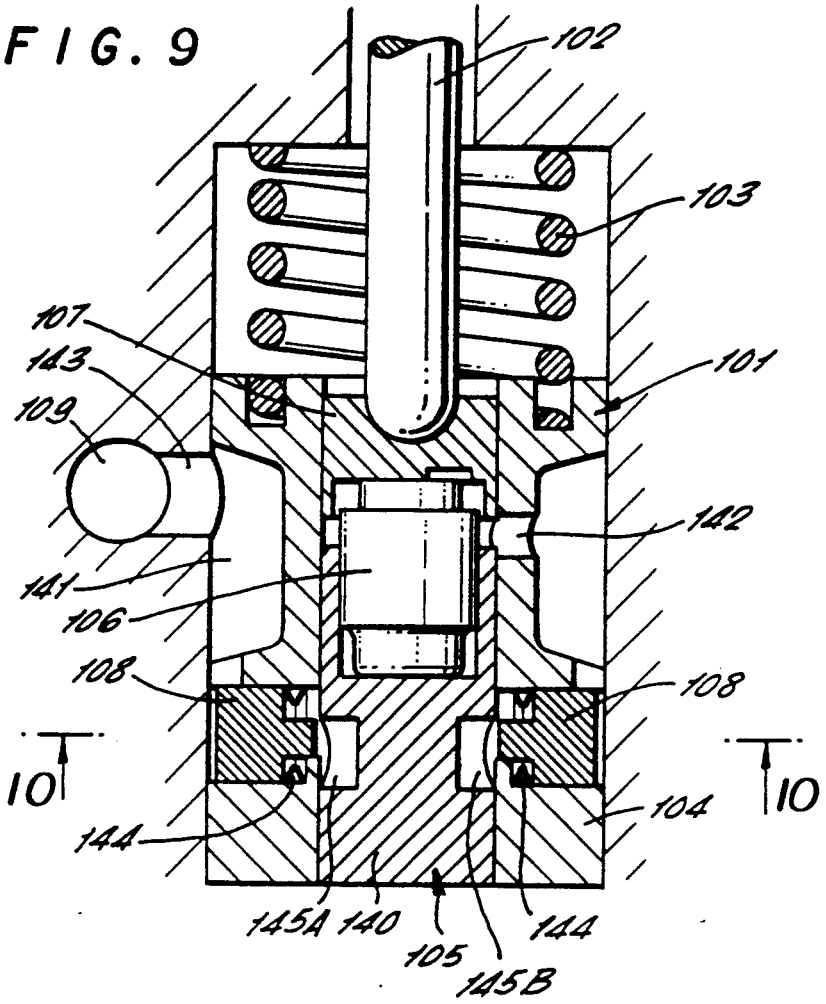
FIG. 9 is a cross-sectional view of the tappet assembly shown in FIG. 8, when installed in an engine, the section being taken along the line B—B of FIG. 10 in the direction of the arrows.
Figure 10:
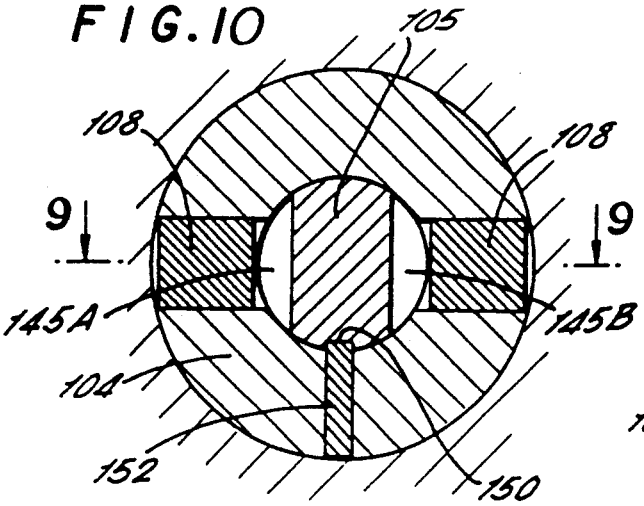
FIG. 10 is a cross-sectional view of the tappet assembly of FIG. 9, taken along the line A—A shown in FIG. 9, in the direction of the arrows.
Figure 11:
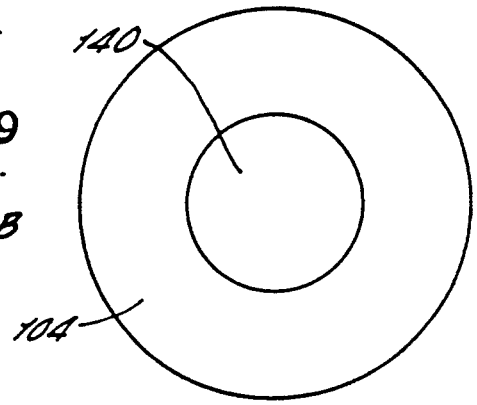
FIG. 11 is a bottom view of the tappet assembly illustrated in FIG. 10.

We will now consider the tappet assembly 101 in more detail with reference to FIGS. 9, 10 and 11.

FIG. 9 shows a cross-sectional view of the tappet assembly 101, when installed in an engine. The tappet assembly is mounted in a bore in the engine block.

The tappet assembly 101 can be seen from FIG. 9 to comprise two elements; an outer cam follower member 104 and an inner cam follower member 105. From the bottom view of the tappet assembly 101 shown in FIG. 11 it can be seen that the outer cam follower member 104 is a cylindrical member which has a cylindrical bore therethrough. The inner cam follower member 105 is also a cylindrical member, with an external radius which matches the radius of the bore in the outer follower member 104.

The outer cam follower member 104 is biased into engagement with the two cams 122 and 124 by a spring 103 which is provided in the bore in the cylinder block to act between the cylinder block and the outer cam follower member 104.

It can be clearly seen in FIG. 9 that the inner cam follower member 105 comprises three portions; a lower portion 140 which provides the contact surface for engaging the cam 123, a push-rod seat 107 and a hydraulic lash adjuster 106 acting between the push-rod seat 107 and the lower member 140. The push-rod 102 engages the push-rod 107 of the inner cam follower member 105, but does not engage in any way the outer cam follower member 104. The hydraulic lash adjuster 106 is located between the push-rod seat 107 and lower member 140, without attachment to either. The components are kept in abutment by the biasing forces of the valve spring 129.

The outer cam follower member 104 is provided with a circumferential recess 141. An aperture 142 is provided through the outer cam follower member 104 in the region of the recess 141, to allow communication between the recess 141 and the cylindrical bore through the cam follower member 104.

An oil gallery 109 is provided in the cylinder block and a passage 143 allows fluid communication between the oil gallery 109 and the bore in the cylinder block in which the tappet assembly 101 is located.

The outer cam follower member 104 is provided with two locking pins 108 which are slidable radially of the outer cam follower member 104 in two radially extending bores provided in the member. Spring means 144 is provided in the bores to bias the locking pins 108 radially outwardly.

As can be seen in FIG. 10 recesses 145A and 145B are provided on the exterior of the lower member 140 of the inner cam follower member 105. A groove 150 runs axially along the exterior of lower member 140 and a locating pin 152 is provided to extend radially inwardly from the outer cam follower member 104 to engage the groove 150 and to prevent rotation of the inner cam follower member 105 relative to the outer cam follower member 104. However, it should be appreciated that the outer cam follower member 104 and the tappet assembly as a whole are free to rotate in the bore in the cylinder head and this minimises wear problems since the cams will engage different portions of the inner and outer cam follower as the tappet assembly rotates.

The method of operation of the embodiment of the invention shown in FIGS. 8 to 11 will now be described.

At low engine speeds the pressure of the oil in the oil gallery 109 will be kept low by suitable control means. It will be appreciated from the foregoing that the oil in the oil gallery 109 communicates via passage 143 and recess 141 with the radially outermost surfaces of the locking pins 108. At low engine speeds the oil pressure in gallery 109 is kept at a level which is insufficient to move the locking pins against the biasing force of the springs 144. However, the pressure is sufficient for an adequate supply of hydraulic fluid via the passage 142 to the hydraulic lash adjuster 106.

Since the oil pressure is insufficient to move the locking pins against the biasing force of the springs 144, the locking pins remain retracted within the outer cam follower member 104. Therefore there is no connection between the outer cam follower member 104 and the inner cam follower member 105 and the inner cam follower member 105 can move relative to the outer cam follower member 104. The valve 127 is therefore driven by the cam 123, which acts on the lower portion 140 of the inner cam follower member 105. The lift of the cam 123 is transmitted to the valve 127 via the following elements; the inner cam follower member 105 (comprising the lower portion 140, the hydraulic lash adjuster 106 and the push-rod seat 107), the push-rod 102 and the rocker arm 112. The spring 129 acts to keep the inner cam follower member 105 in contact with the cam 123.

When the engine speed reaches a certain level, the control means provided in the engine switches the oil pressure in the oil gallery 109 to a high level which is sufficient to move the locking pins 108 against the force of the biasing springs 144. Thus, when the locking pins 108 align with the circumferential recesses 145A and 145B of the inner cam follower member, the locking pins 108 engage the circumferential recesses 145A and 145B to lock the outer cam follower member 104 with the inner cam follower member 105 In this condition, the valve 127 is driven by the cams 122 and 124, which have a higher lift than a cam 123. The cams 122 and 124 engage the outer cam follower member 104 and drive the inlet valve 127 via the outer cam follower member 104, the inner cam follower member 105, the push rod 102 and the rocker arm 112. In this condition, the inner cam follower member 105 will not remain in contact with the cam 123 at all times, because the lift of the cams 122 and 124 is greater than the lift of the cam 123.

During high speed operation of the engine, the pressure of the oil in the oil gallery 109 is kept at a high level to maintain the locking pins 108 in engagement with the circumferential recesses 145A and 145B of the inner cam follower member 105.

When the engine speed is decreased below a chosen level, the control system will reduce the pressure of the oil in the oil gallery 109 to a low level and the springs 144 will move the locking pins 108 out of engagement with the recess 145, to allow relative motion of the inner cam follower member 105 relative to the outer cam follower member 104. The inlet valve 127 will thus again be driven from the cam 123, rather than from the Cams 122 and 124.

Engagement of the locking pins with the circumferential recesses 145A and 145B can only happen when the cam follower members 105 and 104 are in alignment and this only happens during the base circle portions of the cams. Thus, the mechanism allows smooth swapover between the driving of the inlet valve from the cam 123 to the driving of the inlet valve by the cams 122 and 124. Similarly, due to frictional forces between the locking pins 108 and the recesses 145A and 145B, disengagement of the outer cam follower member 104 from the inner cam follower member 105 will occur only when the cam follower members 105 and 104 are both engaging base circle portions of their respective cams.

When the outer cam follower member 104 is not engaged with the inner cam follower member 105, the outer cam follower member 104 is kept in engagement with the cams 122 and 124 by the biasing force exerted on the outer cam follower member 104 by the spring 103.

It will be appreciated that the hydraulic lash adjuster 106 remains in the valve train during low speed and high speed operation of the engine and a supply of hydraulic fluid is maintained to the hydraulic lash adjuster in all conditions. Thus the hydraulic lash adjuster can operate effectively to compensate for wear of elements within the valve drive train.

The valve control means of the apparatus described are very compact in nature. This is very important. In a usual push-rod engine, hydraulic lash adjusters are commonly provided in bores in the cylinder block. It is envisaged that the valve tappet assembly of the invention could be installed simply in a cylinder block by replacing existing hydraulic lash adjusters in the cylinder block with the tappet assembly of the invention. There will already be an oil gallery supplying hydraulic fluid to the existing hydraulic lash adjuster and therefore the installation can be made very cheaply and efficiently.

The embodiment shown in FIG. 8 is suitable for a vee engine and the tappet assembly 139 will be identical the tappet assembly 101. Both tappet assemblies will be supplied from the same oil gallery 109 and will switch from high speed to low speed operations and from low speed to high speed operations at the same time. In fact, there will be several tappet assemblies identical to tappet assembly 101 spaced along the engine, for the different cylinders of the engine. All of the tappet assemblies will be switched simultaneously.

It should be appreciated that in the embodiment shown in FIG. 8 the exhaust valve 111 is controlled by a conventional push-rod and hydraulic lash adjuster valve train, a tappet assembly similar to tappet assembly 101 could also be included in the exhaust valve train, allowing different valve motion at high and low speeds operations of the engine. It should also be appreciated that the system shown in FIG. 8 could be used in any type of push-rod engine, and not just in a vee configuration push-rod engine.

It will be apparent from the foregoing that, while particular forms of the invention have been described, various modifications can be made without departing from the spirit and scope of the invention. Accordingly, it is not intended that the invention be limited, except as by the appended claims.

We claim:

1. Valve control means for a push-rod internal combustion engine comprising:

valve means;

cam means comprising a rotatable camshaft having a first cam member and a second cam member having a different profile from said first cam member;

means for transmitting reciprocating movement to the valve means from said cam means, said transmitting means comprising rocker arm means in engagement with said valve means, a push-rod connected to the rocker arm means, a first cam follower member in engagement with the pushrod and a second cam follower member movable relative to said first cam follower member, and locking means to enable said cam follower members to be linked so as to move together;

the second cam follower member has a bore therethrough and the first cam follower member is in the form of an inner member located within the bore, said first cam follower member being movable in the bore relative to the second cam follower member when the cam followers are not linked to move together.

wherein when the cam follower members are not so linked, the valve means is controlled by the first cam follower member in engagement with and following the profile of the first cam member and when the cam follower members are linked, the valve means is controlled by the second cam follower member in engagement with and following the profile of the second cam member.

2. Valve control means for a push-rod internal combustion engine as claimed in claim 1 wherein the second cam follower member has a bore therethrough and the first cam follower member is in the form of an inner member located within the bore, said first cam follower member being movable in the bore relative to the second cam follower member when the cam follower members are not linked to move together.

3. Valve control means as claimed in claim 2 wherein the second cam follower member is generally cylindrical and has a generally cylindrical bore therethrough and the first cam follower member is a cylindrical member located within the cylindrical bore of the second cam follower member.

4. Valve control means as claimed in claim 3, wherein the locking means comprises a locking element movable within the second cam follower member between a first position in which the cam follower members are not linked and a second position in which the locking element engages a recess provided on the exterior of the first cam follower member to link the two cam follower members.

5. Valve control means as claimed in claim 1 wherein only the first cam follower member directly abuts the push-rod whereby whilst the cam follower members are disconnected the second cam follower member remains disconnected from the push-rod and transmits no motion thereto.

6. Valve control means as claimed in claim 1 wherein the first cam follower member comprises hydraulic lash adjustment means.

7. Valve control means as claimed in claim 1 wherein the first and second cam follower members each respectively directly abut the first and second cam members.

8. Valve control means as claimed in claim 1 wherein the valve means comprises a poppet valve moveable in a bore in a cylinder head of the push-rod internal combustion engine and spring means acting between the poppet valve and the cylinder head to bias the valve into engagement with a valve seat provided therefor, the spring means also acting, via the rocker arm means and the push-rod, to bias the first cam follower member into engagement with the first cam member.

9. Valve control means as claimed in claim 1, further comprising:

a third cam member on the rotatable camshaft having the same profile as the second cam member and provided on the side of the first cam member opposite to the second cam member, wherein the second cam follower member engages with and follows the profiles of both the second and the third cam members.

10. Valve control means as claimed in claim 1 in which actuating means are provided to actuate and deactuate the locking means for different speeds and loads of the engine.

11. Valve control means as claimed in claim 10 in which the actuating means are manually or automatically operable.

12. Valve control means as claimed in claim 10 in which the first and second cam follower members are linked at higher engine speeds to improve efficiency of the engine.

13. Valve control means as claimed in claim 1 in which the locking means comprises a locking element movable within said second cam follower member and held restrained in an unlocked position by spring means.

14. Valve control means as claimed in claim 1 in which the locking means comprises a locking element movable within said second cam follower member and held restrained in an unlocked position by fluid pressure.

15. Valve control means as claimed in claim 14 in which the locking element has a shaped surface adapted to co-operate with a complementary surface of said first cam follower member in a locked position.

16. Valve control means as claimed in claim 14 in which the locking element is moved from an unlocked position to a locked position by means of fluid pressure.

17. Valve control means as claimed in claim 16 wherein the first cam follower member has a stepped portion and the locking element engages the stepped portion to link the first and second cam follower members.

18. Valve control means as claimed in claim 1 in which the second cam follower member is biased toward said second cam member by spring means.

19. Valve control means as claimed in claim 18 in which the spring means hold the second cam follower member in engagement with the second cam member when the cam follower members are not linked to move together.

20. Valve control means as claimed in claim 1 in which, while the second cam follower member is linked in engagement with said first cam follower member, there is a gap between said first cam follower member and said first cam member during the period when the second cam member engages the camming portion of the second cam member.

21. A push-rod internal combustion engine having valve control means as claimed in claim 1 wherein the cylinder block of the engine has a bore in which the first and second cam follower members are located, the second cam follower member being slidable in the bore relative to the cylinder block.

22. A vee configuration push-rod internal combustion engine having valve control means as claimed in claim 1 for controlling valve means of each cylinder of each bank of cylinders.

* * * * *

UNITED STATES PATENT AND TRADEMARK OFFICE

CERTIFICATE OF CORRECTION

PATENT NO. : 5,253,621

DATED : October 19, 1993

INVENTOR(S) : Clive Dopson; Jeffrey Allen

It is certified that error appears in the above-identified patent and that said Letters Patent is hereby corrected as shown below:

Column 10, line 50
Claim 1, line 23, delete "together." and insert therefor --together;--
Column 10, line 67
Claim 3, line 1, delete "2" and insert therefor --1--
Column 12, line 47
Claim 22, line 1, delete "vee" and insert therefor --V--
Column 10, lines 59-66
DELETE ORIGINAL CLAIM 2 IN THIS LETTERS PATENT AND RENUMBER CLAIM 22 TO READ CLAIM 2

Signed and Sealed this

Third Day of October, 1995

*Attest:*

Bruce Lehman

BRUCE LEHMAN

*Attesting Officer*

*Commissioner of Patents and Trademarks*